US009745173B2

(12) United States Patent
Boros et al.

(10) Patent No.: US 9,745,173 B2
(45) Date of Patent: Aug. 29, 2017

(54) HANDRAIL DRIVE FOR AN ESCALATOR OR A MOVING WALKWAY

(71) Applicant: Inventio AG, Hergiswil (CH)

(72) Inventors: Csaba Boros, Dunajska Streda (SK); Michael Matheisl, Vösendorf (AT); Wolfgang Neszmerak, Vienna (AT); Robert Schulz, Vienna (AT)

(73) Assignee: INVENTIO AG, Hergiswil (CH)

( * ) Notice: Subject to any disclaimer, the term of this patent is extended or adjusted under 35 U.S.C. 154(b) by 4 days.

(21) Appl. No.: 15/039,497

(22) PCT Filed: Nov. 14, 2014

(86) PCT No.: PCT/EP2014/074631
§ 371 (c)(1),
(2) Date: May 26, 2016

(87) PCT Pub. No.: WO2015/078709
PCT Pub. Date: Jun. 4, 2015

(65) Prior Publication Data

US 2017/0001843 A1 Jan. 5, 2017

(30) Foreign Application Priority Data

Nov. 27, 2013 (EP) ..... 13194551

(51) Int. Cl.
*B66B 23/04* (2006.01)
*B66B 23/20* (2006.01)
*B66B 23/24* (2006.01)

(52) U.S. Cl.
CPC ..... *B66B 23/04* (2013.01); *B66B 23/20* (2013.01); *B66B 23/24* (2013.01)

(58) Field of Classification Search
CPC ..... B66B 23/04; B66B 23/20; B66B 23/24; B65G 23/14; B65G 23/12
See application file for complete search history.

(56) References Cited

U.S. PATENT DOCUMENTS 4,875,568 A 10/1989 Hermann et al.
5,117,960 A * 6/1992 Ahls ..... B66B 23/04 198/335
5,307,920 A * 5/1994 Meyer ..... B66B 23/04 198/335

(Continued)

FOREIGN PATENT DOCUMENTS

EP 0 644 149 A1 3/1995

*Primary Examiner* — Gerald McClain
*Assistant Examiner* — Keith R Campbell
(74) *Attorney, Agent, or Firm* — Ladas & Parry LLP

(57) ABSTRACT

A handrail drive for driving a handrail of a transportation system has at least one drive device and at least one counterpressure device. The counterpressure device contains at least one taughtening spring and at least one counterpressure-roller. Between the drive device and the at-least one counterpressure-roller, the handrail is arranged approximately in a linear travel direction and, with a press-on force which is caused by the taughtening spring, is pressed by the at-least one counterpressure-roller against the drive device. The handrail drive has a mechanical redirection device, by which the spring-force of the taughtening spring can be redirected into the press-on force of the at-least one counterpressure-roller.

13 Claims, 5 Drawing Sheets

(56) References Cited

U.S. PATENT DOCUMENTS 5,341,909 A * 8/1994 Ahls ..... B66B 23/04
198/335
7,954,619 B2 * 6/2011 Nurnberg ..... B66B 23/04
198/322

* cited by examiner

HANDRAIL DRIVE FOR AN ESCALATOR OR A MOVING WALKWAY

The invention relates to a transportation system which is embodied as an escalator or a moving walk and a handrail drive for such a transportation system.

BACKGROUND OF THE INVENTION

From EP 0 644 149 A1 a handrail drive for an escalator is known. The known handrail drive has a drive device and a pressure device. Between the drive device and the pressure device a handrail is guided and pressure rollers of the pressure unit face the upper side of the handrail. Defined as the upper side is that side of the handrail on which the user of the escalator places their hand in order to hold themselves by the handrail. The drive device further has rollers which are assigned to one part of the pressure rollers, wherein, between the rollers of the drive device and the handrail, a drive-belt passes. In order to taughten the drive-belt, the drive-belt is also passed around a drive-sheave and a taughtening sheave. In operation, the pressure rollers press the handrail against the driven drive-belt, whereby the drive-belt is supported by the rollers of the drive device. The press-on force with which the pressure rollers act on the handrail is generated by a spring of the pressure device.

The handrail drive which is known from EP 0 644 149 A1 has the disadvantage that a large constructive height results, since the pressure rollers are initially borne in an arrangement that is farther away from the upper side of the handrail. This arrangement experiences pressure from the spring of the pressure device, which is even farther away from the upper side of the handrail. Since such handrail drives are normally arranged in the balustrade skirt, on account of their constructive height they must be arranged at the side of the step-band. This inevitably results in a wider escalator construction. However, because of the building dimensions, and for a predefined constructive width, the operators of an escalator or moving walk wish for a step-band or pallet-band that is as wide as possible, in order to achieve a transportation performance of the transportation system that is as high as possible, and to increase the transportation comfort for the users. Further, the handrail drive that is arranged at the side of the step-band can also result in deeper pits in the building, in order that the handrail drive, in particular the spring of the handrail drive, has sufficient space.

The task of the invention is to propose a handrail drive for the purpose of driving a handrail of a transportation system which, for a predefined constructive width of the transportation system, enables the use of a step-band or of a pallet-band which is as wide as possible, and which is optimized in relation to its constructive height.

BRIEF DESCRIPTION OF THE INVENTION

In what follows, solutions and proposals for a corresponding handrail drive and a corresponding transportation system are proposed, which solve at least parts of the set task. Further, advantageous augmentary or alternative further developments and embodiments are presented.

This task is fulfilled by a handrail drive with an optimized constructive height, so that the former can be accommodated in the balustrade skirt, without parts of the handrail drive protruding into the area of the step-band or pallet-band. The handrail drive for driving a handrail of a transportation system has at least one drive device and at least one counterpressure device, and the counterpressure device contains at least one taughtening spring and at least one counterpressure-roller. The handrail is guided in an approximately linear travel direction between the drive device and the at-least one counterpressure-roller and is pressed against the drive device with a press-on force that is caused by the taughtening spring. The optimized constructive height is attained through the taughtening spring being arranged approximately parallel to the travel direction, through the at-least one counterpressure-roller being arranged at-least partly in an extension of the taughtening spring, and through the handrail drive having a mechanical redirection device, by means of which the spring-force of the taughtening spring is redirected into the press-on force of the at-least one counterpressure-roller.

Furthermore, the drive device has at least one driven drive-belt. The drive-belt and the at-least one counterpressure-roller are arranged in relation to each other in such manner that the handrail can be guided between the drive-belt and the at-least one counterpressure-roller and can be pressed by the at least one counterpressure-roller against the drive-belt with the press-on force. Through the drive device acting via the drive-belt on the handrail and driving the latter, the flat construction is also favored, since otherwise, in order to enable the transmission of the driving forces from the drive-sheave to the handrail. a partial wrapping angle on a drive sheave would be necessary.

It should be noted that the handrail of the transportation system is not a component part of the handrail drive. The handrail drive can also be produced and marketed independent of a correspondingly suitable handrail. Further, the handrail drive can also be suitable for differently embodied handrails, or possibly also, in the sense of a modular embodiment for various application purposes, can, in particular, be adaptable for different types of handrails. This results in a great application range for a large number of transportation systems that are embodied as escalators or moving walks.

A preferred use of the handrail drive is for moving walks that are embodied constructively flat. With regard to the foregoing, through the embodiment according to the invention, a moving walk can be realized which sits flat on the ground or floor. The floor of a building, a roofed-over receiving zone, or suchlike can then be embodied flat. This is to be understood as meaning that, for installation of the transportation system, the floor need not be opened, since the handrail drive can be completely accommodated in the balustrade skirt.

A constructively flat handrail drive is also very suitable for a modernization of a transportation system. Through its use, a new balustrade with a handrail can be arranged on the existing escalator, or on the existing moving walk, in the simplest manner, without extensive changes to existing components of the transportation system, for example to the truss, to the guiderails, or to the rail blocks. Through the possibility, by means of the handrail drive according to the invention, of creating transportation systems with reduced external width for the same step- or pallet-band width, the replacement of an existing, old transportation system with a new transportation system is significantly facilitated. Furthermore, the maintenance-friendliness is improved, since the handrail drive according to the invention is very compact and can be mounted on the truss, instead of extending laterally from the truss.

Depending on the force to be transmitted between the drive-belt and the handrail, the drive device can have at least one drive-sheave, at least one taughtening sheave, and a plurality of press-on-force rollers. The drive-belt is driven by the drive-sheave and is arranged in circulating manner between the latter and the taughtening sheave. The press-on-force rollers are arranged within the drive-belt loop and support the drive-belt against the handrail. The counterpressure device has a plurality of counterpressure-rollers. The counterpressure-rollers of the counterpressure device, on the one hand, and the drive-sheave, the taughtening sheave, and the press-on rollers of the drive device on the other hand, are in each case arranged mutually paired. This means that one of the counterpressure-rollers lies opposite the drive-sheave, that one of the counterpressure-rollers lies opposite the taughtening sheave, and that one of the counterpressure-rollers lies opposite each of the press-on-force rollers. In this manner, the driving force can be transferred to the handrail particularly advantageously. Firstly, in this manner, a slippage of the handrail is reliably avoided. Secondly, in this manner, the handrail can be at least largely guided between the drive-belt and the counterpressure-rollers in the travel direction without significant flexures.

In a modified embodiment, it is also possible that not all rollers, or wheels, of the drive device have assigned to them one of the counterpressure rollers. In this embodiment, the drive-sheave and/or the taughtening sheave and/or one or more of the press-on-force rollers then remain without a directly assigned counterpressure-roller. In particular, the drive-sheave and the taughtening sheave can remain without counterpressure-roller, while to each of the press-on-force rollers of the press-on device one of the counterpressure-rollers of the counterpressure device is assigned.

Also advantageous is that the counterpressure-rollers are arranged one behind the other in the extension of the taughtening spring. By this means, the constructive height which is in any case required for the counterpressure-rollers can be optimized and used in advantageous manner to accommodate the taughtening spring.

Further advantageous is that the counterpressure device has a mounting body on which the counterpressure-roller is, or the counterpressure-rollers are, borne. With regard to the foregoing, a further advantage is that a guide is provided which, at least indirectly, is connected with the drive device and that the mounting body, by means of the guide, at least at one point relative to the drive device is guided at least approximately perpendicular to the travel direction. In this manner, the position of the mounting body, and hence each of the positions of the counterpressure-rollers in the travel direction relative to the drive device, in particular the drive-sheave and/or the taughtening sheave and/or the at-least one press-on-force roller, can be maintained, while, in principle, a movement play, or a mobility, or a degree of freedom, exists perpendicular to the travel direction. In particular thereby, the paired assignment of the counterpressure-rollers of the counterpressure device, and of the drive-sheave, of the taughtening sheave, and of the press-on-force rollers of the counterpressure device, can be assured, while the distance of the counterpressure-rollers from the drive-sheave, the taughtening sheave, and the press-on-force rollers of the drive device is, at least with regard to the mean value, variable. In operation, this mobility of the counterpressure-rollers then has the effect that, as the handrail passes through, a necessary movement play can be obtained. With regard to the foregoing, if need be, also surface irregularities that are provided on the handrail, or soilings adhering to the handrail, can be compensated. Further, exactly the mobility of the counterpressure-rollers enables the setting and retention of the desired press-on force, which is caused by the taughtening spring.

With regard to the foregoing, it is also advantageous that the guide is rigidly connected with a taughtening-spring mounting on which the taughtening spring is supported, and that, through the redirection device, the spring force of the taughtening spring exerts force on the mounting body.

Further advantageous is that at least a first axle is provided on the mounting body in locationally fixed manner, that the redirection device has at least a first axle-guide, in which the first axle is guided, and that the axle-guide guides the first axle with a predefined redirection angle relative to the thrust-direction of the spring-force of the taughtening spring. The characteristic "predefined redirection angle" defines that, independent of the position of the axle within the axle-guide, in the axle-guide always an inclination is present which transforms the spring-force into the press-on force.

Correspondingly, also advantageous is that a first axle and at least a second axle is provided in locationally fixed manner on the mounting body, that the redirection device has a first axle-guide, in which the first axle is guided, and at least a second axle-guide, in which the second axle is guided, that the first axle-guide guides the first axle with a predefined redirection angle relative to the direction of the spring-force of the taughtening spring, and that the second axle-guide guides the second axle with the (same) predefined redirection angle relative to the direction of the spring-force of the taughtening spring. In this manner, the direction of the spring-force of the taughtening spring is redirected. When ideally implemented, and when the friction forces and suchlike are ignored, the dimensional implementation of the spring-force of the taughtening spring results from the parallelogram of forces which is determined by the redirection angle. Hence, the spring-force of the taughtening spring can be converted depending on the redirection angle. However, the redirection angle does not necessarily need to be constant along the length of the axle-guide. Depending on the embodiment of the axle-guide (for example, curved), an increasing or decreasing conversion ratio between spring-force and press-on force can be achieved. In addition, in different manner, a damping of the vibration behavior that is enabled by the taughtening spring can take place. With regard to the foregoing, in the at-least one axle-guide, the friction can be used for the purpose of damping vibrations. This friction can also be influenced by the choice of a corresponding redirection angle.

An advantageous bearing and guiding of the diversion device within the counterpressure device can be created by the diversion device having at least one sliding guide-shoe, by the counterpressure device having a sliding guide, and by the taughtening-spring mounting, on which the taughtening spring is supported, being arranged locationally fixed relative to the sliding guide. Further, the friction between the at-least one sliding guide-shoe and the sliding guide can also be used to damp the vibration system that is present on account of the taughtening spring.

Hence, through the friction of the at-lease one axle-guide, and through the friction between the at-least one sliding guide-shoe and the sliding guide, an advantageous damping of vibrations upon driving of the handrail takes place, while an advantageous adaptation in relation to the specific application case is possible.

The redirection angle which is provided in the axle-guide, or axle-guides, is preferably chosen from a range of 10° to 45°. Further advantageous is that the redirection angle is chosen from a range of 10° to 30°. Further advantageous is that the redirection angle is chosen from a range of 15° to 25°, and in particular, that approximately 20° is chosen.

Also advantageous is that a counterpressure-roller is borne on the first axle. In the case where a plurality of counterpressure-rollers is provided, this means that one of the counterpressure-rollers is borne on the first axle. The counterpressure-roller which is borne on the first axle is preferably the counterpressure-roller which is arranged nearest to the taughtening spring. Also this embodiment contributes to a compact construction of the handrail drive.

Further advantageous is that one of the counterpressure-rollers is borne on the second axle. In the case of a plurality of counterpressure-rollers, this means that one of the counterpressure-rollers is borne on the second axle. If a plurality of counterpressure-rollers is provided, then it is advantageous that one of the counterpressure-rollers is borne on the first axle and that one of the counterpressure-rollers is borne on the second axle. In the case of a plurality of axles, which also includes the case of two axles, it is advantageous that on each of the axles, or on at least some of the axles, always one of the counterpressure-rollers is borne. By this means, a space-saving construction is enabled.

Also advantageous is that the counterpressure-roller which is borne on the second axle is the counterpressure-roller which is arranged farthest from the taughtening spring. Should even further axles, in other words more than two axles, be provided, then further counterpressure-rollers can be arranged in advantageous manner between the first axle and the second axle.

Hence further advantageous is that a second axle is provided in locationally fixed manner on the mounting body, that the redirection device has a second axle-guide, in which the second axle is guided, and that the second axle-guide guides the second axle with the predefined redirection angle relative to the direction of the spring-force of the taughtening spring. This applies particularly for more than two axles. In addition, counterpressure-rollers can also be arranged on axles which are not guided in the redirection device in this manner.

The transportation system can have one or more handrail drives. As a result of the redirection device, the individual handrail drive has a press-on force which depends on the travel direction. Through a suitable alignment, for example, for upward travel a higher press-on force can be obtained, while for downward travel a lower press-on force can be obtained. By this means, in downward travel the handrail can be relieved. The cause of the dependence of the (effective) press-on force on the travel direction is that, as a result of the redirection angle of the axle-guide in the travel direction, forces that act on the counterpressure-rollers act against, or add to, the force of the taughtening spring. The larger the acute redirection angle, the less the effect of the travel direction. Or, differently expressed, the larger the redirection angle, which must be chosen smaller than 90°, the less the influence of the travel direction.

In order to avoid a travel-direction dependency, the handrail drive can also have two counterpressure devices, which are arranged mirror-symmetrically relative to a reflecting plane. These two counterpressure devices are only half as long as the drive device, so that one half of the required counterpressure-rollers are assigned to the first counterpressure device and the other half of the required counterpressure-rollers are assigned to the second counterpressure device. The reflecting plane extends perpendicular to the travel direction of the handrail and is arranged approximately centrally to the drive device.

Self-evidently, the transportation system can also have a plurality of handrail drives. For example, two handrail drives can be used, which are mutually oppositely aligned. If the same press-on force is required in both travel directions, then the two handrail drives can be arranged with mutual mirror-image symmetry. With regard to the foregoing, each handrail drive has its own taughtening spring. In this manner, in a modified embodiment, press-on forces which are travel-direction dependent can also be set in targeted manner.

Self-evidently, existing transportation systems can be modernized, through their at-least one existing handrail drive being replaced by at least one handrail drive with a diverter device. This may cause further changes to be necessary to the existing transportation system, for example to the truss, to guides of the handrail, to electrical systems, and other suchlike.

BRIEF DESCRIPTION OF THE DRAWINGS

Preferred exemplary embodiments of the invention are expounded in more detail in the following description by reference to the attached drawings, in which identical elements are referenced with identical numbers. Shown are in FIG. 1: in diagrammatic depiction an escalator with a truss and two reversing zones, wherein, arranged on the truss, are balustrades with a circulating handrail.

DETAILED DESCRIPTION OF THE INVENTION

Figure 1:
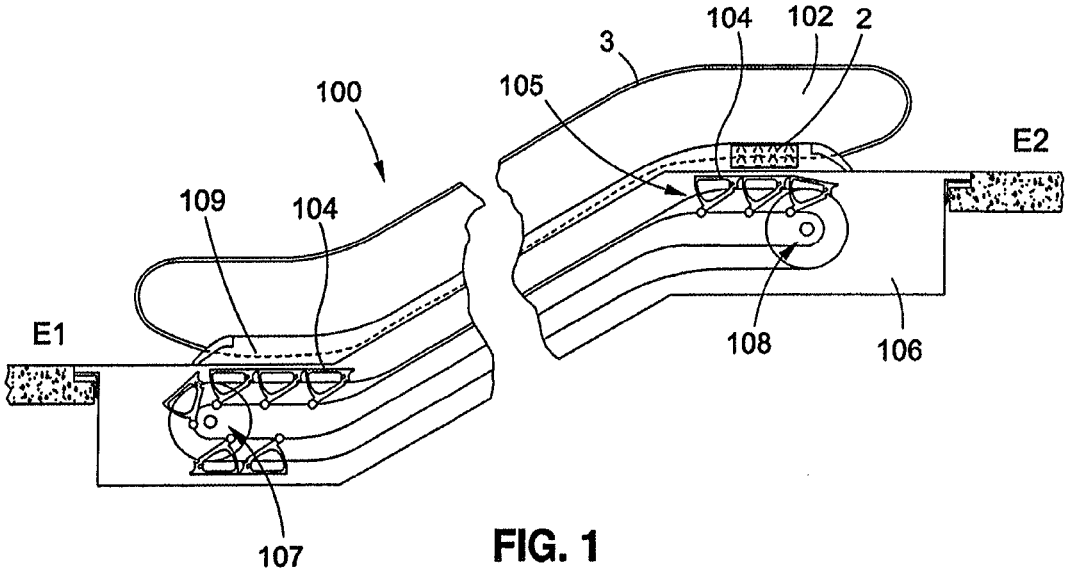

FIG. 1 shows diagrammatically in the side view a transportation system 100, which is embodied as an escalator 100 and which connects a first story E1 with a second story E2. The escalator 100 has a truss 106 with two reversing zones 107, 108, between which a step-band 105 with a plurality of steps 104 is guided in circulating manner. Arranged on a balustrade 102 in circulating manner is a handrail 3. At its lower end, by means of a balustrade skirt 109, the balustrade 102 is connected with the truss 106. The transporting passage of the handrail 3 takes place along the upper edge of the balustrade 102 and the return passage of the handrail 3 takes place within the balustrade skirt 109. For the purpose of driving the circulating handrail 3, arranged within the balustrade skirt 109 is a handrail drive 2. Because of its small constructive height, the handrail drive 2 is fastened onto an upper girder of the truss 106. Normally, an escalator 100 has two balustrades 109, each with a handrail 3, while the step-band 105 is arranged between the two balustrades 102. Correspondingly, for the purpose of driving the two circulating handrails 3, two handrail drives 2 are also necessary.

Figure 2:
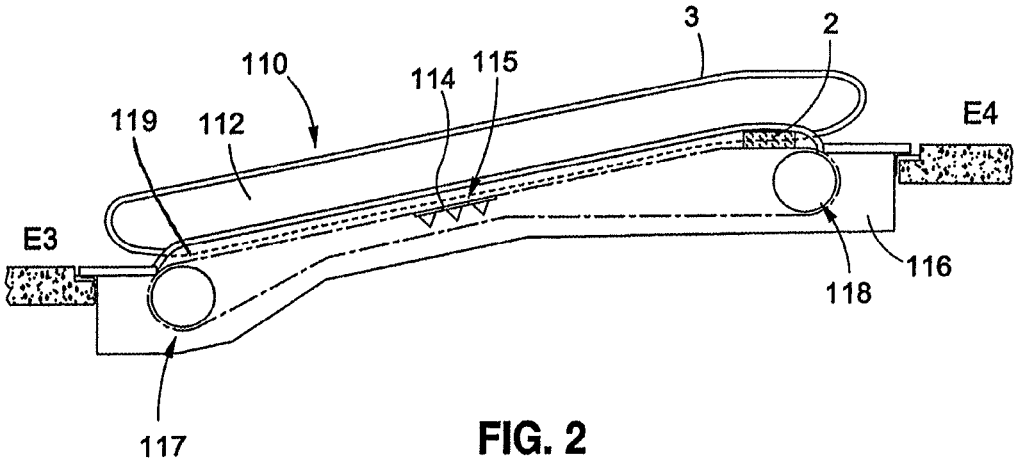
FIG. 2: in diagrammatic depiction, a moving walk with a truss and two reversing zones, wherein, arranged on the truss, are balustrades with a circulating handrail.

FIG. 2 shows diagrammatically in the side view a transportation system 110 constructed in similar manner, which is embodied as a moving walk 110, which also has a balustrade 112 with balustrade skirt 119, a handrail 3, a truss 116, and two reversing zones 117, 118. Different from the escalator 100 of FIG. 1, arranged between the reversing zones 117, 118 of the moving walk 110 is not a step-band 115 but a pallet-band 115 with a plurality of pallets 114. The moving walk 110, for example, connects a third story E3 with a fourth story E4. The handrail 3 and the handrail drive 2 of the moving walk 110 correspond to the handrail 3 and the handrail drive 2 of the escalator 100 of FIG. 1, for which reason the identical reference numbers are used. Normally, also in the case of a moving walk 110, two balustrades 112 with handrails 3 are used, which extend at both sides of the pallet-band 115.

Figure 3:
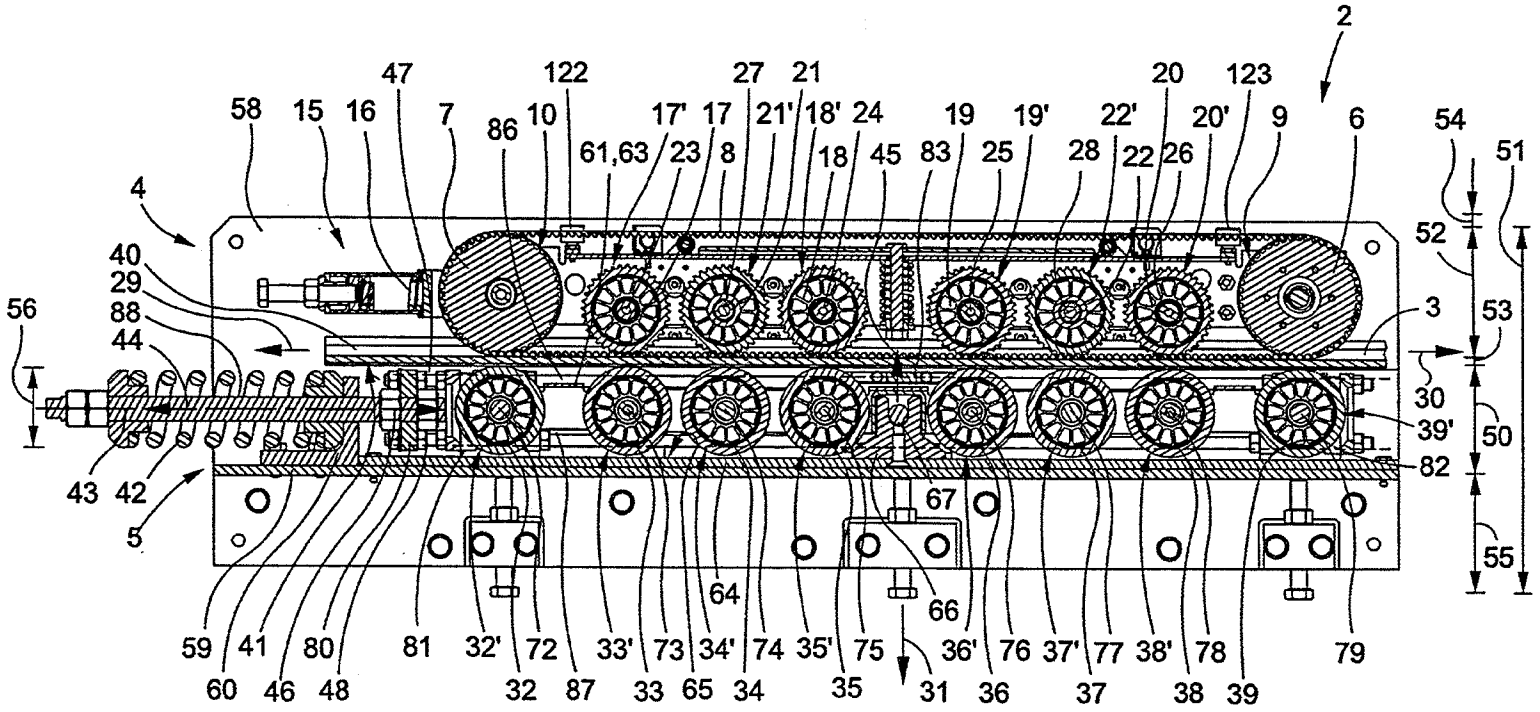
FIG. 3: the handrail drive shown in FIGS. 1 and 2 and a section of the handrail in cross-sectional depiction.

FIG. 3 shows the handrail drive 2 of FIGS. 1 and 2, and a part of the handrail 3, in a partial, diagrammatic cross-sectional depiction corresponding to an exemplary embodiment of the invention. The handrail drive 2 can be manufactured and marketed independent of the other components of the transportation system. The handrail drive 2 according to the invention is preferably used in transportation systems or transportation devices which are embodied as escalator 100 or moving walk 110.

The handrail drive 2 has a drive device 4 and a counter-pressure device 5. In an adapted embodiment, the handrail drive 2 can, for example, also have a further counterpressure device 5, which is embodied corresponding to the counter-pressure device 5. Further, the transportation system 100, 110 can also have a plurality of handrail drives 2, for the purpose of, for example, driving a plurality of handrails 3. Thereby in particular, handrails 3 can be driven, which are provided to the left and right, when viewed in the travel direction, of the standing-surface for persons and/or objects of the transportation system 100, 110.

The drive device 4 has a drive-sheave 6, a taughtening sheave 7, and a drive-belt 8. The drive-belt 8 is passed over the drive-sheave 6 and the taughtening sheave 7. In this exemplary embodiment, the drive-sheave 6 and the taughtening sheave 7 each have on their running surfaces 9, 10 a spur gear. Correspondingly, the drive-belt 8 is embodied as a toothed belt 8. The positive engagement results in a reliable, slip-free transmission of the driving force of the drive-sheave 6 onto the drive-belt 8. Self-evidently, also a poly-v belt could be used as drive-belt 8.

By means of an adjustable taughtening device 15, which contains a belt-taughtening spring 16, the taughtening sheave 7 experiences a force away from the drive-sheave 6. The drive-belt 8 is thereby taughtened.

The drive device 4 also has a plurality of press-on rollers 17 to 22. The running surfaces 17' to 22' of the press-on rollers 17 to 22 each have a spur gear 17' to 22'. With the spur gears 17' to 22', the press-on-force rollers 17 to 22 mesh with the teeth of the drive-belt (toothed belt) 8.

In this exemplary embodiment, the press-on rollers 17 to 20 are borne on locationally fixed axles 23 to 26 within the drive device 4. The press-on-force rollers 21, 22 are borne on movable axles 27, 28. In operation, the handrail 3 can travel, for example, in a travel direction 29. A further possible travel direction 30 is in the direction opposite to the travel direction 29. To simplify the depiction, where necessary, reference is made to only one of the travel directions 29, 30, however, for the expert, it is evident when what is described also applies in corresponding manner for the respective opposite travel direction 29, 30. In order to ensure a consistently high press-on force, also the press-on-force rollers 17 to 22 have a toothed profile.

The moveable axles 27, 28 are movable within the mechanically foreseen limits, and opposite to the direction 31, which is perpendicular to the travel direction 29. This preferably results in a force being exerted on the press-on-force rollers 21, 22 in the direction 31 against the drive-belt 8.

The counterpressure device 5 has counterpressure-rollers 32 to 39. The counterpressure-rollers 32 to 39 have running surfaces 32' to 39', which, in this exemplary embodiment, are embodied as smooth running surfaces 32' to 39'. Whereas the inside 40 of the handrail 3 faces the press-on-force rollers 17 to 22 and the drive-sheave 6 and the taughtening sheave 7, an upper side 41 of the handrail 3 faces the counterpressure-rollers 32 to 39. However, the press-on rollers 17 to 22, and the drive-sheave 6 and the taughtening sheave 7, do not rest directly against the inside 40 of the handrail 3. Sections of the drive-belt 8 rest directly against the inside 40 of the handrail 3. Hence, the press-on rollers 17 to 22, and the drive-sheave 6 and the taughtening sheave 7, act on the handrail 3 through the drive-belt 8. Hence, by means of the drive-belt 8, the driving force in the chosen travel direction 29, 30 can be transferred to the handrail 3.

In this exemplary embodiment, the counterpressure-rollers 32 to 39 rest with their running surfaces 32' to 39' directly against the upper side 41 of the handrail 3. The handrail 3 experiences from the counter-pressure rollers 32 to 39 a press-on force 42 against the drive-belt 8, which is caused by a taughtening spring 42. This press-on force 45 preferably acts against the direction 31 and hence perpendicular to the travel direction 29 of the handrail 3.

In this exemplary embodiment, the taughtening spring 42 of the counterpressure device 5 is arranged parallel to the travel direction 29. In general, the at-least one taughtening spring 42 is arranged at least approximately parallel to the travel direction 29. This means that a thrust-direction 43 of the taughtening spring 42, along which the spring-force 44 of the taughtening spring 42 acts, is aligned parallel to the travel direction 29. With regard to the foregoing, the parallel alignment is to be understood as relative to the respective center-line axes and includes a so-called anti-parallel alignment.

The drive-belt 8 of the drive device 4, and the counter-pressure-rollers 32 to 39, are therefore arranged relative to each other in such manner that the handrail 3 can be guided in the travel direction 29 between the drive-belt 8 and the counterpressure-rollers 32 to 39. The handrail is therefore pressed by the counterpressure-rollers 32 to 39 against the drive-belt 8 with the press-on force 45. The press-on force 45 is, in turn, caused by the taughtening spring 42, that is to say, by the spring-force 44 of the taughtening spring 42.

With regard to the foregoing, the counterpressure-rollers 32 to 39 are arranged at least partly in an extension 46 of the taughtening spring 42. With regard to the foregoing, in FIG. 3 the boundaries 47, 48 of this extension 46 are indicated by dashed lines 47, 48. With regard to the foregoing, the boundary 47 represents the upper boundary 47 relative to the direction of the press-on force 45, whereas in this respect the boundary 48 represents the lower boundary. By this means, a height 50 of the counterpressure device 5 can be optimized, which means be as small as possible. Correspondingly, the constructive height 51 of the handrail drive 2, which is composed of the height 50 of the counterpressure device 5, a height 52 of the drive device 4, a height 53 of the handrail 3, and any constructively necessary additional heights 54, 55, can be reduced. Such additional heights 54, 55, can, however, be comparatively easily reduced, if it is advantageous in the specific application case. With regard to the foregoing, it is of significance that a vertical dimension 56 of the taughtening spring 42 has no influence on the constructive height 51 of the handrail drive 2, since the dimension 56 of the taughtening spring 42 lies completely within the height 50 of the counterpressure device 5. With regard to the foregoing, the dimension 56 is determined by the distance between the upper boundary 47 and the lower boundary 48. In this exemplary embodiment, the dimension 56 is equal to the external diameter of the taughtening spring 42. However, the taughtening spring 42 is not necessarily embodied as a helical spring, so that then, the dimension 56 results in corresponding manner from the distance between the upper boundary 47 and the lower boundary 48 of the extension 46. For example, the term "taughtening spring" 42 also includes an assembly of a plurality of helical springs which are arranged in a direction 57 (FIG. 5), which is both perpendicular to the travel direction 29 and perpendicular to the direction 31. Self-evidently, the taughtening spring 42 can also be an assembly of disk-springs. In a special arrangement, for example, two or more helical springs, which serve as taughtening springs 42, can be arranged parallel to each other in a horizontal plane without the vertical dimension 56 being thereby increased.

It is hence particularly advantageous that the counterpressure-rollers 32 to 39 are only partly arranged in the extension 46 of the taughtening spring 42. In this exemplary embodiment, this is indicated in that the counterpressure-rollers 32 to 39 extend beyond the upper boundary 47 to the handrail 3 (so in FIG. 3, upwards) and, in this case, even extend also away from the handrail 3 (so in FIG. 3, downwards), beyond the lower boundary 48.

In this exemplary embodiment, the handrail drive 2 has a support 58, onto which the drive device 4 and the counterpressure device 5 are fastened. With regard to the foregoing, tightly connected with the support 58, or the support plate 58 respectively, is a fastening bracket 59 of the counterpressure device 5.

The handrail drive 2 of the transportation system 100, 110 is described further below, also by reference to FIG. 4 and FIG. 5. For greater clarity, in FIGS. 4 and 5 only the most important reference numbers are shown.

Figure 4:
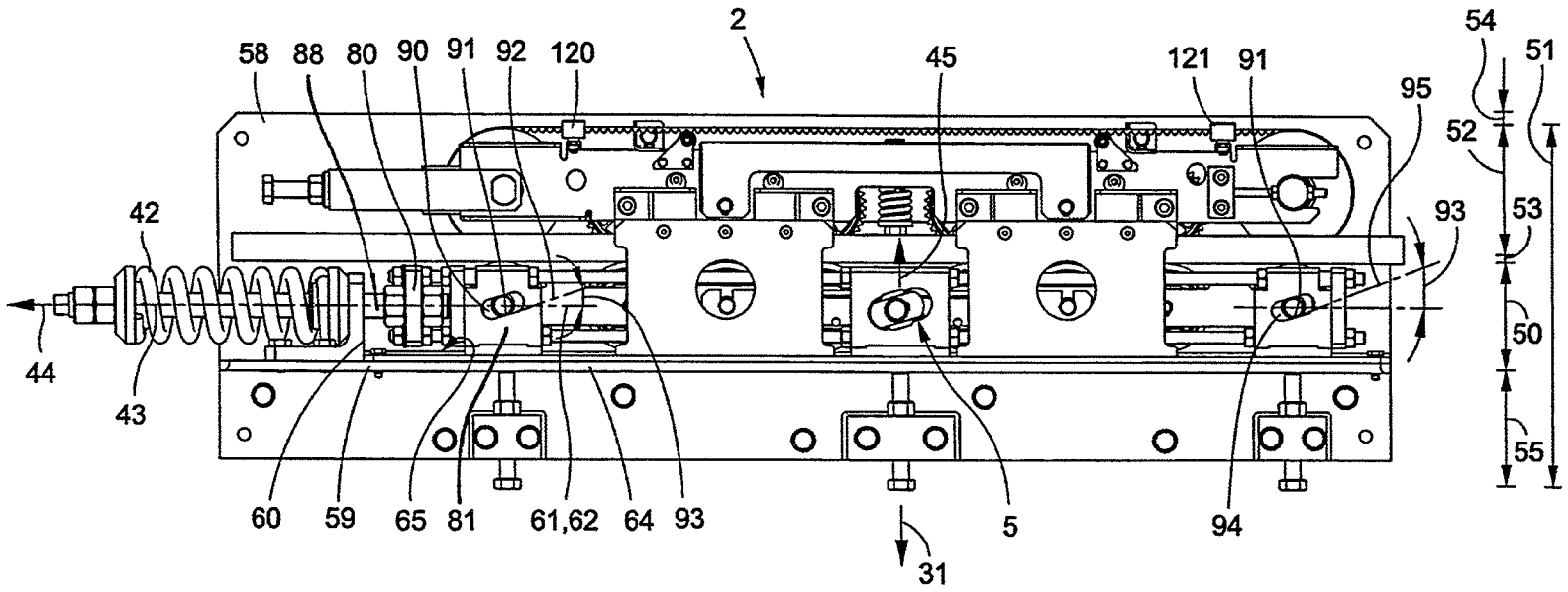
FIG. 4: a side view of the handrail drive depicted in FIG. 3.
Figure 5:
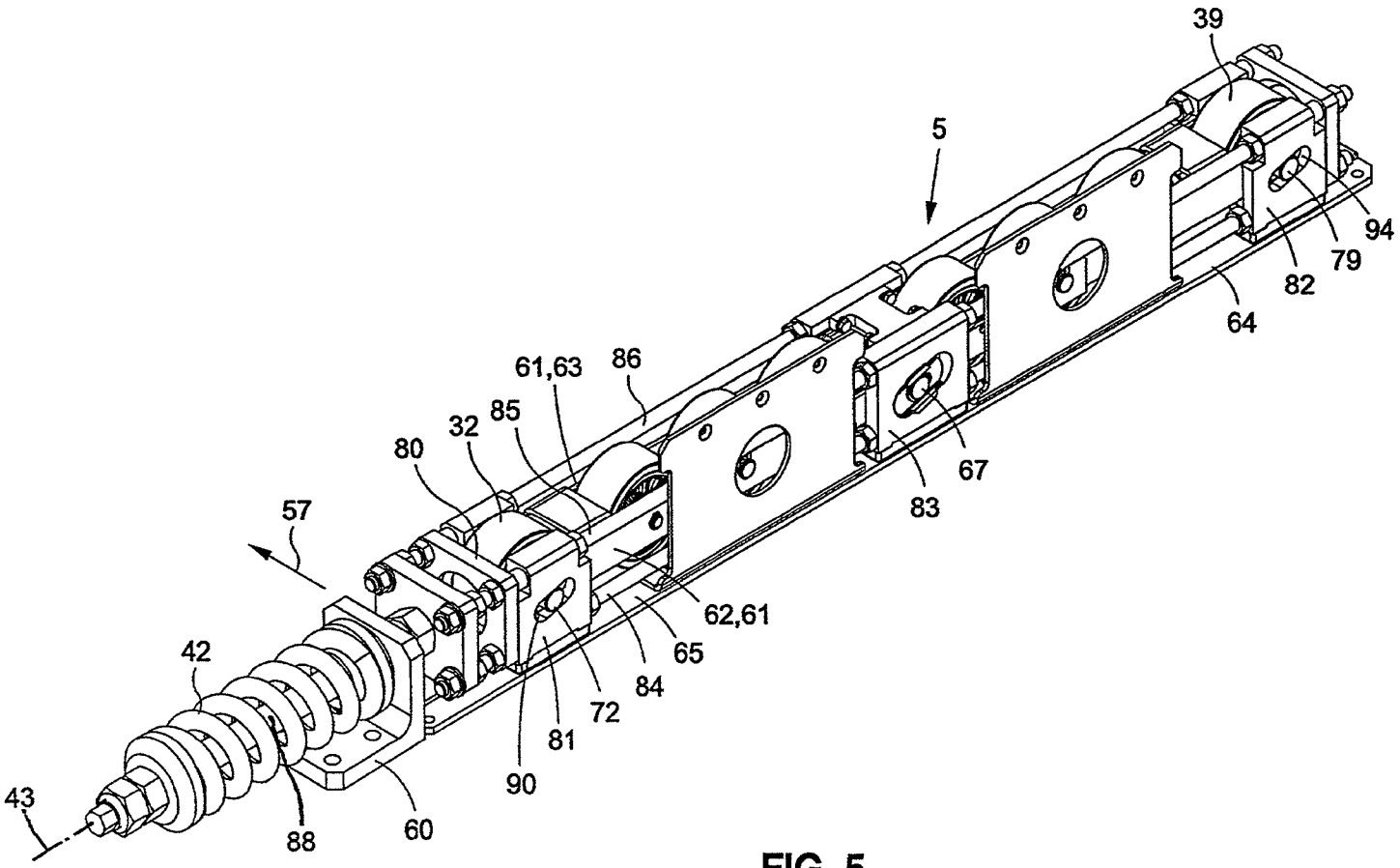
FIG. 5: a counterpressure device of the handrail drive depicted in FIG. 3 in a diagrammatic three-dimensional depiction corresponding to the exemplary embodiment of the invention.

FIG. 4 shows the handrail drive 2 which is depicted in FIG. 3 in a partial, diagrammatic depiction corresponding to the exemplary embodiment of the invention. FIG. 5 shows in a diagrammatic, three-dimensional depiction the counterpressure device 5 of the handrail drive 2 corresponding to the exemplary embodiment of the invention. The counterpressure device 5 has a taughtening-spring mounting 60, which is tightly connected with the fastening bracket 59. Since the fastening bracket 59 is tightly connected with the support 58, the taughtening-spring mounting 60 is also therefore arranged locationally fixed relative to the support 58. In addition, the counterpressure device 5 has a mounting body 61, which contains bearing plates 62, 63 (FIG. 3) for bearing the axles 72 to 79. In addition, the counterpressure device 5 also has a sliding device 64, which, in this exemplary embodiment, is embodied by a sliding plate 64. However, in a correspondingly modified embodiment, the sliding device 64 can also be formed by, for example, sliding rails. Embodied on the sliding plate 64 is a sliding track 65. Since the sliding plate 64 is tightly connected with the fastening bracket 59, the sliding track 65 is positioned locationally fixed relative to the support 58.

The taughtening-spring mounting 60, on which the taughtening spring 42 is supported, is hence locationally fixed relative to the sliding track 65.

The counterpressure device 5 also has a guide 66 (FIG. 3), which, by means of the sliding plate 64 and the fastening bracket 59, is connected with the support 58 and hence with the drive device 4. The mounting body 61 has a guide-pin 67, which at one end is connected with the bearing plate 62 and at the other end is connected with the bearing plate 63. The guide-pin 67 is guided in the guide 66. Through the guide-pin 67, at this point the mounting body 61 is guided relative to the drive device 4. With regard to the foregoing, the guidance takes place at least approximately perpendicular to the travel direction 29. In operation, the direction of the press-on force 45 results along the guide of the guide-pin 67 in the guide 66.

The counterpressure-rollers 32 to 39 are borne on axles 72 to 79, which are in each case connected at one end with the bearing plate 62 and in each case at the other end with the bearing plate 63. The counterpressure-rollers 32 to 39 are thus borne in the mounting body 61. With regard to the foregoing, the counterpressure-rollers 32 to 39 are borne sequentially on the mounting body 61 in the extension 46 of the taughtening spring 42.

Of the axles 72 to 79, the axle 72 can be designated as first axle and the axle 79 as second axle. Since, in this exemplary embodiment, more than two axles 72 to 79 are provided, on which the counterpressure-rollers 32 to 39 are borne, the axles 73 to 78 can be designated as "further axles".

The first axle 72 and the second axle 79 are provided locationally fixed on the mounting body 61. With regard to the foregoing, mounted on the first axle 72 is the counterpressure-roller 32 and on the second axle 79 the counterpressure-roller 39. With regard to the foregoing, the counterpressure-roller 32 is assigned to the taughtening sheave 7. The counterpressure-roller 39 is assigned to the drive-sheave 6.

It should be noted that, in a modified embodiment, the first axle 72 can also be integrated in the mounting body 61 as additional axle on which no counterpressure-roller is arranged. Additionally, or alternatively, also the second axle 79 can be integrated in the mounting body 61 as additional axle, on which no counterpressure-roller is arranged. To this extent, the embodiment which is described by reference to the exemplary embodiment represents a preferred special case in which the counterpressure-rollers 32, 39 are arranged on the first axle 72 and on the second axle 79. Therefore, for the realization of the function of the first axle 72 and of the second axle 79, which is described in more detail below, no additional axles are needed, as a result of which the space requirement for the counterpressure device 5 is reduced.

The counterpressure device 5 of the handrail drive 2 has a redirection device 80. The redirection device 80 has sliding guide-shoes 81 to 83, connecting rods 84 to 87, and further components. With regard to the foregoing, to simplify the depiction, only the sliding guide-shoes 81 to 83 and the connecting rods 84 to 87 (see FIGS. 3 and 5) are referenced.

Through its sliding shoes 81 to 83, the redirection device 80 is borne on the sliding track 65. Thereby, a mobility of the redirection device 80 along the thrust-direction 43 is enabled. With regard to the foregoing, the thrust-direction 43 is aligned parallel to the sliding track 65. With regard to the foregoing, the taughtening-spring mounting 60 is aligned parallel to the sliding track 65. Through the spring-force 44 of the taughtening spring 42, the redirection device 80 experiences a force in the direction of the spring-force 44. Hence, the taughtening spring 42 in itself has the function of pulling the redirection device 80 towards the taughtening-spring mounting 60. With regard to the foregoing, the taughtening spring 42 is connected in suitable manner, at least indirectly, with the redirection device 80, which, in this exemplary embodiment, takes place inter alia via a rod 88.

The redirection device 80 serves to redirect the spring-force 44 of the taughtening spring 42 into the press-on force 45 of the counterpressure-rollers 32 to 39. With regard to the foregoing, the redirection device 80 is embodied as a mechanical redirection device 80. The redirection device 80 has a first axle-guide 90 with a guide-track 91. In this exemplary embodiment, the first axle-guide 90 is embodied in the sliding guide-shoe 81. With regard to the foregoing, the first axle-guide 90 is embodied as a two-ended axle-guide 90, which guides the first axle 72 at both of its ends. With regard to the foregoing, the first axle-guide 90 guides the first axle 72 at one end near to the bearing plate 62, and at the other end, near to the bearing plate 63 of the mounting body 61. The guide-track 91 is thereby, in a manner of speaking, formed by two flat pieces that lie in a guide-plane 92. The guide-plane 92 and the thrust-direction 43 enclose a predefined redirection angle 93. The characteristic "predefined redirection angle 93" defines that, independent of the position of the axle 72 within the axle-guide 90, in the axle-guide 90, or in its guide-plane 92 respectively, an incline is always present which redirects the spring-force 44. Hence, the redirection angle 93 is greater than 0°. Furthermore, the redirection angle 93 is an acute redirection angle 93, hence also smaller than 90°. The redirection angle 93 is preferably chosen from a range of 5° to 45°. In particular, the redirection angle 93 can be chosen from a range of 10° to 30°. Further, in particular, the redirection angle 93 can be chosen from a range of 15° to 25°. Especially, the size of the redirection angle 93 can be approximately 17° to 20°.

On account of the exertion by the taughtening spring 42 of a force on the redirection device 80, between the first axle 72 and the guide-track 91 of the first axle-guide 90, the spring-force 44 acts along the thrust-direction 43. Since, through the guide-pin 67 and the guide 66, the mounting body 61, with the bearing plates 62, 63, has no degree of freedom, the spring-force 44 is redirected into the press-on force 45, which, in this exemplary embodiment, is aligned perpendicular thereto. Hence, the mechanical redirection device 80 enables the redirection of the spring-force 44 of the taughtening spring 42 into the press-on force 45. With regard to the foregoing, when friction effects and suchlike are ignored, the dimensional relationship results from the force parallelogram on the guide-track 91, which is inclined to the thrust-direction 43 by the redirection angle 93.

Through the support 59, the guide 66 is rigidly connected with the taughtening-spring mounting 60, on which the taughtening spring 42 is supported, as a result of which, through the redirecting device 80, the spring-force 44 of the taughtening spring 42 exerts a force on the mounting body 61.

In corresponding manner, the sliding guide-shoe 82 has a second axle-guide 94 with a guide-track 91. With regard to the foregoing, the guide-track 91, which is formed of two flat pieces, lies in a guide-plane 95. The guide-plane 95 encloses the same redirection angle 93 to the thrust-direction 43 as the guide-plane 92 also encloses to the thrust-direction 43. Hence, in this exemplary embodiment, the redirection of the spring-force 44 of the taughtening spring 42 into the press-on force 45 takes place both at the first axle-guide 90 and at the second axle-guide 94. Since the manner of functioning and embodiment of the redirection at the second axle-guide 42 therefore corresponds to that at the first axle-guide 90, a repetitive description is unnecessary.

In a modified embodiment, further axles, which are integrated in the mounting body 61, can be borne in further axle-guides 90, with the same redirection angle 93 being again foreseen. Further, if necessary, the redirection can take place also at one single axle-guide or, as illustrated in the present exemplary embodiment, also in the area of the guide-pin 67 and the guide 66.

In this exemplary embodiment, the counterpressure-roller 32 which is mounted on the first axle 72 is the counterpressure-roller 32 which is arranged nearest to the taughtening spring 42, or the taughtening-spring mounting 60, respectively. Further, the counterpressure-roller 39 which is borne on the second axle 79 is the counterpressure-roller 39 which is arranged farthest away from the taughtening spring 42, or taughtening-spring mounting 60, respectively. In this manner, the stability of the arrangement of the mounting body 61 in the redirection device 80 can be improved. For example, by this means, a tipping, and an associated jamming or wedging, can be avoided.

For the purpose of guiding the drive-belt 8, in this exemplary embodiment guide-rollers 120 to 123 are provided, which are depicted in the FIGS. 3 and 4. By this means, it is assured that the drive-belt 8 passes reliably over the drive-sheave 6 and the taughtening sheave 7, and hence also over the running surfaces 17' to 22' of the press-on-force rollers 17 to 22.

In operation of the transportation system or of the handrail drive 2 respectively, with the press-on force 45 through the handrail 3, the counterpressure-rollers 32 to 39 are pressed against the drive-belt 8. Since, in the direction of the press-on force 45, the drive-sheave 6, the taughtening sheave 7, and the press-on-force rollers 17 to 20 are not movably borne, a force-equilibrium therefore arises when the handrail 3 runs at least predominantly in a straight line in the travel direction 29 between the drive device 4 and the counterpressure device 5. The movement of the redirection device 80 on the sliding track 65 of the sliding plate 64 is thereby restricted.

In operation of the transportation system, forces are transmitted through the handrail 3 into the counterpressure device 5 which have a non-zero force-component along the thrust-direction 43. Depending on the respective travel direction 29, 30, this component acts against, or increases, the spring-force 44. This therefore also influences the press-on force 45. Therefore, the press-on force 45 depends on the respective travel direction 29, 30 of the handrail 3.

Figure 6:
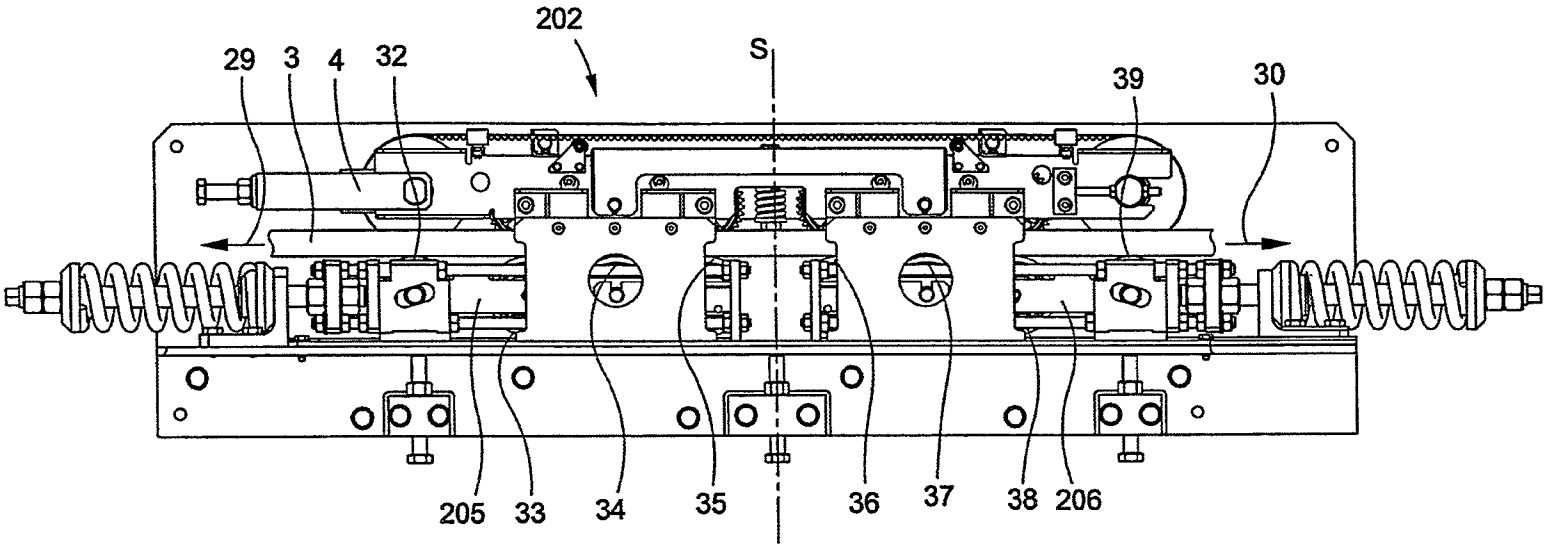
FIG. 6: diagrammatically in side view, a handrail drive with two counterpressure devices which are arranged mutually mirror-symmetrically.

In a modified embodiment, the counterpressure device which is described further above can be provided a further time, in a manner of speaking, in the form of a mirror image. FIG. 6 shows diagrammatically in the side view a handrail drive 202 with two counterpressure devices 205 and 206, which are arranged with mirror-image symmetry relative to a reflecting plane S. The reflecting plane S extends perpendicular to the travel direction 29, 30 of the handrail 3 and is arranged approximately centrally to the drive device 4.

If the counterpressure-rollers 32 to 39 are correspondingly distributed on the two counterpressure devices 205, 206, the counterpressure device 205 and the further, mirror-image counterpressure device 206 can then be assigned to one single drive device 4. Embodiments are, however, also conceivable in which a further drive device 4 is provided. For each handrail 3 which is to be driven, the transportation system 100, 110 can also have two handrail drives 2 which are embodied as mutual mirror images, which are arranged, for example, at the two ends of the traveling standing-surface for persons and/or objects, or before the balustrade end-curves at which the handrail 3 is also reversed.

Although the invention has been described by the depiction of specific exemplary embodiments, it is self-evident that, with knowledge of the present invention, numerous further variant embodiments can be created, for example, in that instead of compression springs, tension springs or disk springs are used. Further, in the exemplary embodiment of FIG. 6, the two taughtening springs can also be replaced by a central spring which is arranged between the two counterpressure devices 205, 206. Depending on the position of their guide-planes, the central spring can be a tension spring or a compression spring. With this arrangement, the two taughtening-spring supports are also obviated. The handrail drive 2 according to the invention can be used both in an escalator and in a moving walk.

The invention claimed is:

1. A handrail drive for driving a handrail of a transportation system, the handrail drive comprising:

at least one drive device and at least one counterpressure device having a mounting body with a guide and includes at least one tautening spring and at least one counterpressure roller mounted to the mounting body, the handrail being guided approximately in a linear travel direction between the drive device and the at least one counterpressure roller;

the at least one counterpressure roller exerting upon its at least one drive device a press-on force caused by the at least one tautening spring, the at least one tautening spring being arranged approximately parallel to the travel direction and the at least one counterpressure roller being arranged at least partly at an extension to the at least one tautening spring, the at least one drive device having at least one driven drive belt, the at least one drive belt and the at least one counterpressure roller being mutually arranged whereby the handrail is guided between the at least one drive belt and the at least one counterpressure roller, the press-on force being exerted upon the handrail by a spring force of the at least one tautening spring redirected by a mechanical redirection device to the at least one counterpressure roller for pressing against the at least one drive belt, the mechanical redirection device having a first axle-guide in which a first axle is guided, the first axle-guide guiding the first axle along a predefined redirection angle relative to a thrust-direction of the at least one tautening spring's spring force.

2. The handrail drive according to claim 1, wherein the at least one drive device has at least one drive sheave, at least one tautening sheave, and a plurality of press-on-force rollers, the at least one drive belt being driven by the at least one drive-sheave, wherein the at least one counterpressure device has a plurality of the at least one counterpressure roller, the plurality of the at least one counterpressure roller of the at least one counterpressure device being assigned in a mutually paired manner with the at least one drive-sheave, the at least one tautening sheave, and the press-on-force rollers of the at least one drive device.

3. The handrail drive according to claim 2, wherein the plurality of the at least one counterpressure rollers are sequentially arranged at the extension of the at least one tautening spring.

4. The handrail drive according to claim 1, wherein the mounting body has the guide connected with the at least one drive device for guiding the mounting body approximately perpendicular to the travel direction.

5. The handrail drive according to claim 4 further comprising a tautening spring mounting for supporting the at least one tautening spring, wherein the guide is rigidly connected to the tautening spring mounting.

6. The handrail drive according to claim 5, wherein the first axle is provided on the mounting body in a locationally fixed manner.

7. The handrail drive according to claim 6, wherein a counterpressure roller of the at least one counterpressure roller is mounted on the first axle.

8. The handrail drive according to claim 7, wherein the counterpressure roller of the at least one counterpressure roller mounted on the first axle is a counterpressure roller arranged nearest to the tautening spring.

9. The handrail drive according to claim 6 wherein a second axle is provided in a locationally fixed manner on the mounting body, the mechanical redirection device having a second axle guide in which the second axle is guided, the second axle-guide guiding the second axle with the predetermined direction angle relative to the thrust-direction.

10. The handrail drive according to claim 1, wherein the mechanical redirection device has at least one sliding guide shoe, the at least one counterpressure device has a sliding track on which the at least one sliding guide shoe is borne, a tautening spring mounting, on which the at least one tautening spring is supported, is arranged locationally fixed to the sliding track.

11. The handrail drive according to claim 1, wherein the at least one counterpressure devices are two in number and are arranged mirror-symmetrically to a reflecting plane (S) extending perpendicular to the travel direction of the handrail and arranged approximately centrally to the at least one drive device.

12. A transportation system comprising an escalator or moving walk, having a moveable handrail and a handrail drive according to claim 1.

13. A method for modernizing an existing transportation system comprising the step of replacing at least one existing handrail drive of the transportation system with at least one handrail drive according to claim 1.

* * * * *